United States Patent [19]

Bauer et al.

[11] Patent Number: 4,899,969

[45] Date of Patent: Feb. 13, 1990

[54] LOCKABLE ELEVATING MECHANISM FOR THE CONTINUOUS ADJUSTMENT OF FURNITURE AND GUIDE SLEEVE FOR SUCH AN ELEVATING MECHANISM

[75] Inventors: Hans-Peter Bauer; Hans J. Bauer, both of Altdorf, Fed. Rep. of Germany

[73] Assignee: Fritz Bauer and Sohne oHG, Altdorf, Fed. Rep. of Germany

[21] Appl. No.: 291,693

[22] Filed: Dec. 29, 1988

[30] Foreign Application Priority Data

Jan. 28, 1988 [DE] Fed. Rep. of Germany ... 880976[U]

[51] Int. Cl.[4] ..... F16M 11/00

[52] U.S. Cl. ..... 248/161; 297/347

[58] Field of Search ..... 248/161, 157, 404, 407, 248/415, 562; 108/147, 148, 144, 107; 297/347

[56] References Cited

U.S. PATENT DOCUMENTS

| | | | |
|---|---|---|---|
| 3,711,054 | 1/1973 | Bauer . | |
| 4,323,088 | 4/1982 | McClellan | 248/62 X |
| 4,485,996 | 12/1984 | Beukema et al. | 248/407 |
| 4,493,469 | 1/1985 | Holobaugh | 108/147 X |
| 4,592,590 | 6/1986 | Slaats et al. | 248/404 X |
| 4,613,106 | 9/1986 | Tornero | 297/347 X |
| 4,655,426 | 4/1987 | von Dulong et al. | 248/422 X |
| 4,720,068 | 1/1988 | Tornero | 248/161 |
| 4,756,496 | 7/1988 | Hosan et al. | 248/161 |

FOREIGN PATENT DOCUMENTS

| | | |
|---|---|---|
| 0133524 | 11/1987 | European Pat. Off. . |
| 7235759 | 2/1973 | Fed. Rep. of Germany . |

*Primary Examiner*—Alvin C. Chin-Shue

*Attorney, Agent, or Firm*—Browdy and Neimark

[57] ABSTRACT

A lockable elevating mechanism for the continuous adjustment of chair seats or the like comprises a guide tube, in which a length-adjustable, lockable gas spring is slidably guided. The piston rod of the gas spring is connected to the bottom plate of the guide tube. The housing of the gas spring is guided by means of a guide sleeve in the guide tube, the guide sleeve having a central carrying tube, in which slide sleeves are arranged with space. The carrying tube is surrounded by a carrying sleeve held in the guide tube. Thus a gas spring is obtained, on the one hand, which is free of bracing, resistant to wear and with good sliding qualities, and, on the other hand, the manufacturing of the guide sleeve is favorable in terms of material expenditure.

11 Claims, 2 Drawing Sheets

LOCKABLE ELEVATING MECHANISM FOR THE CONTINUOUS ADJUSTMENT OF FURNITURE AND GUIDE SLEEVE FOR SUCH AN ELEVATING MECHANISM

FIELD OF THE INVENTION

The invention relates to a lockable elevating mechanism for the continuous adjustment of seats, table tops of the like, with a guide tube connectable to a pedestal and with a length-adjustable, lockable gas spring. The piston rod is axially firmly but removably connected to a bottom plate of the guide tube. The housing can be axially firmly, but in principle removably connected to the seat or the table top in the area opposite the piston rod of the gas spring. The housing may be possibly surrounded by an additional tube and is guided laterally firmly and axially slidably by means of a guide sleeve held in the guide tube, and which has an activating rod for length-adjustment of the gas spring.

BACKGROUND OF THE INVENTION

Such an elevating mechanism is known from U.S. Pat. No. 3,711,054. The cylindrical outer surface of the housing of the gas spring is directly guided in a guide sleeve connected to the guide tube. The gas spring is not only a supporting and length-adjustable element of a chair or table column, but also a leading and a pivoting element. Since the piston rod is attached to the bottom plate of the guide tube not only freely pivoting, but also with sufficient radial play, the gas spring can adjust to any possible change in stress direction of the seat or the table top, respectively, so that, on the whole, there is little risk of bracing in the guide sleeve. In another elevating mechanism according to the preamble of claim 1, the housing of the gas spring is surrounded by an additional tube, in which the housing of the gas spring is arranged axially unslidable. In this case the additional tube is guided pivotably and longitudinally slidable in the guide sleeve (European Patent No. 0 133 524 corresponding to Japanese utility model No. 60-54446 and U.S. Application Ser. No. 756,844, appeal pending).

The known embodiments have one-piece guide sleeves consisting of high-quality wear-resistant material. They are pressed into the guide tubes. Subsequently the guide surface of the sleeve serving as a slide surface is adapted to the precise dimensions by turning or rubbing. This is necessary because, due to their size, the guide sleeves have wide tolerances and because they are deformed differently when they are pressed into the guide tube. This treatment is expensive. Furthermore, the demands on the guide sleeve to have good sliding qualities, of being resistant to wear and still to offer the possibility to be pressed into the guide tube with corresponding hard-elastic deformation, are very difficult to be realized altogether in terms of material.

From German utility model No. 72 35 759 it is known for an elevating mechanism for the continuous adjustment of chair seats to guide a gas spring in two guide sleeves spaced apart, each of which is provided with support and guide surfaces. The two guide sleeves are pressed into a guide tube and held spaced apart by a distance tube. A special effect of this is not given in German utility model No. 72 35 759.

SUMMARY OF THE INVENTION

It is an object of the invention to provide a guide sleeve of a lockable elevating mechanism of the generic kind which is resistant to wear, has good sliding qualities and which allows the guiding of the gas spring to be free of bracing.

It is a further object of the invention to provide a guide sleeve of a lockable elevating mechanism of the generic kind which is favourable in terms of material expenditure.

These objects of the invention are attained in that the guide sleeve has a central carrying tube, in which slide sleeves are arranged with space therebetween, and which is surrounded by a carrying sleeve held in the guide tube.

The steps according to the invention ensure that the slide sleeves can be made from a material with high resistance to abrasion on the one hand and with good sliding qualities vis-à-vis metal on the other hand. Due to the fact that the slide sleeves are arranged spaced apart, the gas spring or the additional tube surrounding it, respectively, are guided without bracing. On the other hand, it is sufficient to embody the carrying sleeve only with regard to its being pressed into the guide tube, i.e., comparatively cheap plastics may be chosen as material, since wear-resistance and sliding qualities are of no importance. Due to the fact that a carrying tube of metal is arranged between the slide sleeves on the one hand and the carrying sleeve when pressed into the guide tube do not affect the dimensions and the shape of the guide surfaces of the slide sleeves.

Further advantages, feature and details of the invention will become apparent from the ensuing description of an embodiment, taken in conjunction with the drawings.

DESCRIPTION OF THE PREFERRED EMBODIMENT

Figure 1:
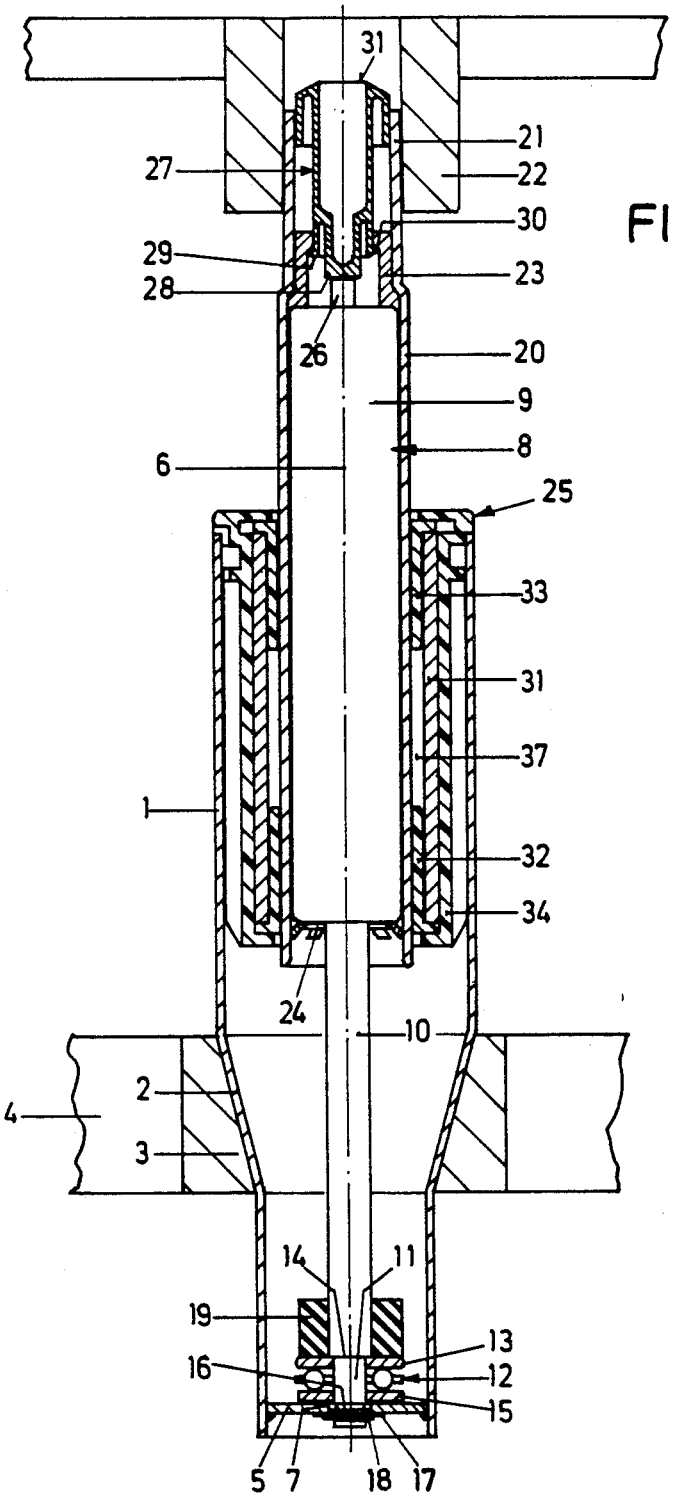
FIG. 1 is a longitudinal section of an elevating mechanism.

The lockable elevating mechanism for the continuous adjustment of seats or table tops, shown in the drawings, has a lower guide tube 1, generally designed in cylindrical form, which has in its lower part a section 2, conically tapered downwardly, which contains a corresponding collar 3 of a pedestal 4. The guide tube 1 has a bottom plate 5 near its lower end showing an opening 7 which is concentric to the central longitudinal axis 6 of the entire elevating mechanism and therefore also to the guide tube 1. Disposed parallel to the longitudinal axis 6 is a length-adjustable, hydraulically or pneumatically lockable gas spring 8. The cylindrical housing 9 of the spring is located in the upper area of, and extends upwardly through, the guide tube 1. The piston rod 10 of the spring extends downwardly through the housing 9 and is removably connected with the bottom plate 5. For this purpose, the free end of the piston rod 10 is designed with a tang 11, which has a reduced diameter, on which is disposed an axial ball bearing 12, the upper race 13 of which is supported against the collar 14 formed in the transition area between the tang 11 and the piston rod 10, while the lower race 15 is supported against the bottom plate 5. In addition, a securing collar 16, mounted on the tang, holds the axial ball bearing 12 in the position shown, even if the lower race 15 is not supported against the end plate 5.

The tang 11 is placed into the opening 7 with sufficient play of from some tenth of a millimeter to a millimeter, so that the piston rod 10 is not radially braced with respect to the guide tube 1. From the outside, i.e., at the bottom, a spacer 17, having a diameter larger than that of the opening 7, is placed on the tang 11. A securing element 18 is pushed against the spacer 17 so that the piston rod 10 of the gas spring 8 is firmly connected to the guide tube 1 axially, but removably. On the piston rod 10 there is an end positioning, or impact, damper 19 made from rubber, which rests with its underside against the upper race 13 of the axial ball bearing 12.

The continuously circular cylindrical housing 9 of the gas spring 8 is disposed with sliding fit in a tube 20, which is also circular cylindrical in its essential length. The radial play between the housing 9 and the tube 20 is some one hundredth of a millimeter to maximally one or two-tenth of a millimeter. The play is therefore just sufficient to insert the housing 9 of the gas spring 8 into the tube 20 or to pull it out therefrom and, at the same time, to guide the housing 9 in the tube 20 radially and to hold it. This tube 20, forming a removable part of the gas spring 8, is provided in its upper part, which extends above the housing 9, with a conically tapered fastening segment 21, which forms a solid, simply made plug connection with a corresponding collar 22 fastened to the underside of a chair, armchair, table top or the like. At the transition of the fastening segment 21, a casing 23, designed in accordance with the tapering of the tube 20, is disposed in the latter and is therefore fixed axially in the direction towards the fastening segment 21. The housing 9 of the gas spring 8 is axially firmly supported against this casing 23.

At the lower free end of the tube 20, the housing 9 is axially held by means of a removable fastening element 24. This can be in the form of a so-called claw, i.e. a ring provided with resilient tabs, which can be pushed into the tube 20 in one direction, namely until it rests against the housing 9, with relative ease, but which resists movement in the opposite direction by barb-like bracing against the tube. With sufficient force, for instance by the use of a screw driver, it can be easily taken out in a downwardly direction, thus breaking the connection between the housing 9 and the tube 20 in a simple manner. Naturally, many other kinds of fastening elements, including screw connections, can be considered.

This tube forms a removable part of the gas spring 8 and is axially movable in the usual manner in the guide tube 1. This guide tube is provided in its upper area with a guide sleeve 25, which will be described in detail below. The guide tube 1 and the tube 20 are made of steel. The same is the case for the housing 9 of the gas spring 8, while the casing 23 consists of a softer material, for instance die cast zinc.

Longitudinal adjustment of the gas spring 8 and corresponding height adjustment of the entire elevating mechanism is achieved with the help of an activating rod 26 of the gas spring 8, which extends from the upper end of gas spring 8 away from the piston rod 10, and which is pushed into the housing 9 in order to make possible the respective adjustment in length. For this purpose, an upward extending slide 27 is disposed in the conically tapering fastening segment 21 and rests against the activating rod 26 with a face 28. Furthermore, this slide 27 is supplied with securing prongs 29, which elastically grip the back or underside of a corresponding ring 30 of the casing 23, and permit the slide 27 to be secured against inadvertent falling out of, or removal from, the fastening segment 21 while, at the same time, assuring the seating with little play of the face 28 against the activating rod 26. Activation is accomplished by means of a swivelable activating lever, not shown, which is disposed in the collar 22 in the usual manner and which rests against the outer surface of the slide 27, as is known, for instance, from U.S. Pat. No. 3,790,119.

The gas spring 8 need not forcibly be arranged in an additional cylindrical tube 20; it can also be directly guided with its housing in the guide sleeve 25 and fastened to the underside of a chair, a table-to or the like. This is for example known from U.S. Pat. No. 3,711,054, which was referred to above.

Figure 2:
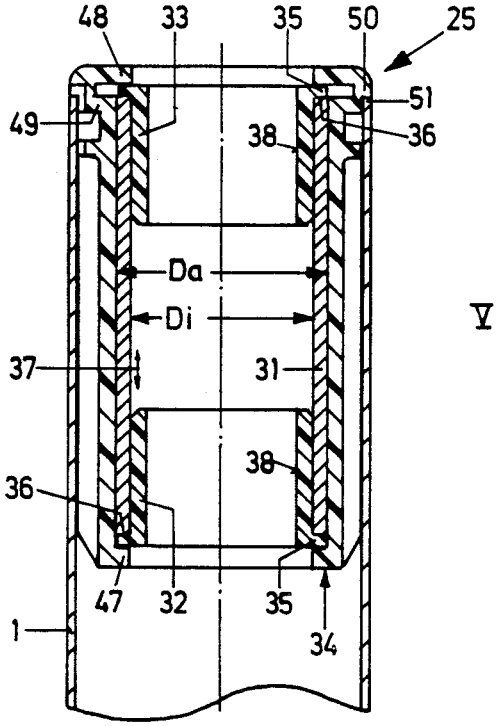
FIG. 2 is a longitudinal section of a guide sleeve according to the invention.
Figure 4:
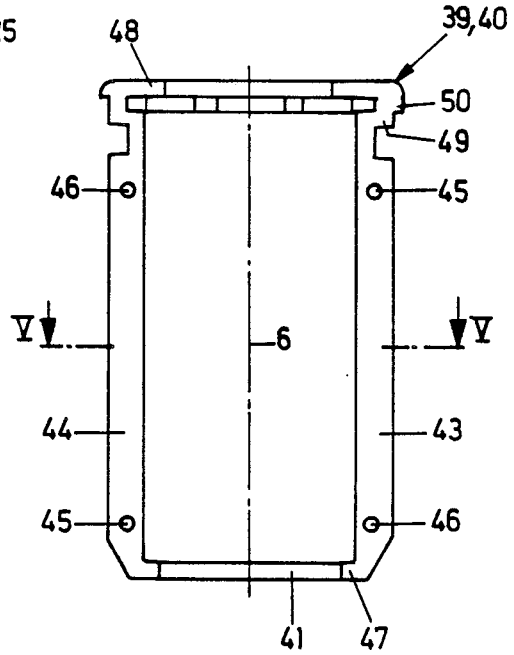
FIG. 4 is a longitudinal view of a semi-sleeve of the guide sleeve.
Figure 3:
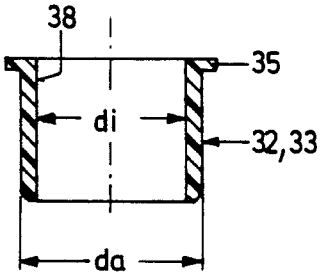
FIG. 3 is a longitudinal section of a slide sleeve.
Figure 5:
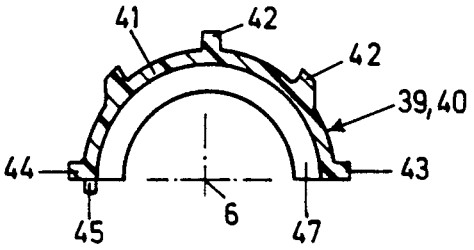
FIG. 5 is a cross-section of the semi-sleeve according to the intersection line V—V in FIG. 4.

The guide sleeve 25 consists of several parts. It comprises a carrying tube 31 with slide sleeves 32, 33 inserted and an outer two-piece carrying sleeve 34. The carrying tube 31 is of circular cylindrical shape, having, in particular, a relatively precise inner diameter Di with only little tolerance. The two slide sleeves 32, 33 are identical. Prior to insertion into the carrying tube 31 they have an outer diameter of some one hundredth of a millimeter more than the inner diameter Di of the carrying tube 31, for example of from 0.02 to 0.09 mm. At one end the circular cylindrical slide sleeves 32, 33 have an outwardly extending collar 35. The slide sleeves 32, 33 are inserted in the carrying tube 31 in such a way that each of its two ends presses in one slide sleeve 32 or 33, respectively, to such point where the collar 35 rests against the face 36 of the carrying tube 31. FIG. 2 shows that the two slide sleeves 32, 33 extend over one fourth to one third of the length of the carrying tube 31, so that a space 37 of about one third to two fourths of the length of the carrying tube 31 is formed between the two slide sleeves 32, 33. The inner surfaces of the slide sleeves 32, 33 serving as guide surfaces 38 for the housing of the gas spring or the tube 20, respectively, are thus also spaced apart so that the tube 20 or a housing of the gas spring, respectively, are guided only by these spaced apart guide surfaces 38. The inner diameter Di of the slide sleeves 32, 33 corresponds to the outer diameter of the housing of a gas spring or to the outer diameter of the tube 20, respectively, with the usual guide play.

The two-piece carrying sleeve 34 consists of two semi-sleeves 39, 40 of the same kind, which basically consists of a semi-circular cylindrical section 41, from which ribs 42 extend outwards running parallel to the axis 6. The semi-sleeves 39, 40 have longitudinal flanges 43, 44, which rest against each other when the semi-sleeves 39, 40 are joined together. They rest against each other in a plane through the central longitudinal axis 6. These longitudinal flanges 43, 44 are provided with tangs 45 and matching openings 46, so that the tangs 45 of one semi-sleeve 39, 40 engage with the opening 46 of the other semi-sleeve 40 or 39, respectively, when the two semi-sleeve 39, 40 are joined together. One end of each of the semi-sleeves 39, 40, namely the lower end, is provided with an semi-circular abutment 47 extending radially inwards. FIG. 2 shows that the collar 35 of the corresponding slide sleeve 32 rests against the abutment 47 when the guide sleeve is assembled, so that the carrying tube 31 with the two slide sleeves 32, 33 is axially arrested in one direction. In the opposite direction the carrying tube 31 with the two slide sleeves 32, 33 is arrested in such a way that an semi-circular abutment 48 is provided at each of the two semi-sleeves 39, 40 equally extending inwards over the semi-circular cylindrical section, against which the collar 35 of the adjacent slide sleeve 33 rests axially. FIG. 2 shows that this upper abutment 48 is slightly resilient in axial direction, so that, on the one hand, it compensates length tolerances of the carrying tube 31 with the two slide sleeves 32, 33 and, on the other hand, holds the carrying tube 31 with the two slide sleeves 32, 33 axially without play, thus firmly arresting it. For this purpose this abutment 48 is given the shape of a semi-ring disk reaching to the radial outside area of the ribs 42, where it is secured to a semi-ring land 49, which extends outwards and has an outer diameter that corresponds to the inner diameter of the guide tube 1. At the juncture of this semi-ring land 49 and the abutment 48 is further provided a ring collar 50 resting against the corresponding face 51 of the guide tube 1 when the completely assembled guide sleeve 25 is shoved in.

The carrying tube 31 already equipped with the slide sleeves 32, 33 is inserted in one of the semi-sleeves 39, 40. Then the other semi-sleeve 40 or 39, respectively, is installed and the tangs 45 engage with the matching openings 46. This completely assembled guide sleeve 25 is then shoved into the guide tube 1 to the point where the ring collar 50 rests against the face 51. The ribs 42 are thus slightly elastically deformed so that the whole guide sleeve 25 is firmly arrested in the guide tube 1. Since the carrying tube 31 is practically not deformable consisting of steel or aluminum or of a comparable metal, the tolerance-caused deformations of the carrying sleeve 34 do not affect the inner diameter Di of the slide sleeves 32, 33 and thus the precise dimensions of the guide surfaces 38.

Beyond that, the semi-sleeves 39, 40, which are comparatively expensive in material and which consist of one piece each, can be made of less expensive plastic material with especially good sliding qualities vis-à-via metal, in particular steel. The tube 20 and the housing of a directly guided gas spring, respectively, consists of metal. Polyacetal is considered to be a plastic material with especially good sliding qualities.

The outer diameter Da of the carrying tube 31 is chosen in such a way that it is held in the carrying sleeve 34 without play.

What is claimed is:

1. A lockable elevating mechanism for continuous adjustment of a unit such as a seat, table top or the like comprising:

a guide tube having means for connecting the guide tube to a pedestal;

a length-adjustable lockable gas spring;

a piston rod of the gas spring being axially, with respect to a central longitudinal axis of the mechanism, firmly but removably connected to a bottom plate of the guide tube;

a housing of the gas spring being axially firmly but removably connected to the unit in the area opposite the piston rod;

a guide sleeve held in the guide tube and guiding laterally firmly supports an outer tube of the housing, which outer tube axially slides, with respect to the said guide sleeve along the central longitudinal axis, an outer tube of the housing; and an activating rod for length-adjustment of the gas spring and protruding axially, with respect to the central longitudinal axis, from the housing opposite the piston rod wherein the guide sleeve has a central carrying tube, a pair of slide sleeves arranged spaced apart from one another within said central carrying tube and a carrying sleeve surrounding said central carrying tube and held in the guide tube.

2. An elevating mechanism according to claim 1, wherein the carrying sleeve consists of two identical one-piece semi-sleeves.

3. An elevating mechanism according to claim 2, wherein the semi-sleeves have abutments extending radially inwards in the area of their axial ends, against which the carrying tube with the slide sleeves rests without play.

4. An elevating mechanism according to claim 3, wherein at least one abutment is made axially elastically resilient.

5. An elevating mechanism according to claim 2, wherein the semi-sleeves are provided with longitudinal flanges which have tangs and matching openings.

6. An elevating mechanism according to claim 3, wherein the slide sleeves are each axially held by means of a ring collar between the adjacent face of the carrying tube and the adjacent abutment of the carrying sleeve.

7. An elevating mechanism according to claim 1, wherein the slide sleeves are held with pressure or adhesion in the carrying tube.

8. An elevating machanism according to claim 1, wherein the carrying tube consists of metal.

9. An elevating mechanism according to claim 1, wherein the slide sleeves comprise two slide sleeves which extend over one fourth to one third of the length of the carrying tube.

10. An elevating mechanism according to claim 2, wherein the semi-sleeves basically consist of a semi-circular cylindrical section, from which ribs extend outwards running parallel to the central longitudinal axis of the mechanism and resting against the guide tube.

11. An elevating mechanism according to claim 1, wherein the guide sleeves are made from a material with relatively high resistance to abrasion and relatively good sliding qualities vis-a-vis metal and the carrying sleeve is formed of a plastic material.

* * * * *